US011952168B2

(12) United States Patent
Bree et al.

(10) Patent No.: US 11,952,168 B2
(45) Date of Patent: Apr. 9, 2024

(54) LINKING STRUCTURE AND CONTAINER ASSEMBLY TO FACILITATE LIQUID TRANSFER FROM A DONOR CONTAINER TO A RECIPIENT CONTAINER

(71) Applicant: Anne Marie Bree, Lebanon, NJ (US)

(72) Inventors: Elizabeth Marie Bree, Lebanon, NJ (US); Anne Marie Bree, Lebanon, NJ (US)

( * ) Notice: Subject to any disclaimer, the term of this patent is extended or adjusted under 35 U.S.C. 154(b) by 0 days.

(21) Appl. No.: 18/021,002

(22) PCT Filed: Sep. 7, 2022

(86) PCT No.: PCT/US2022/042781

§ 371 (c)(1),
(2) Date: Feb. 13, 2023

(87) PCT Pub. No.: WO2023/038988

PCT Pub. Date: Mar. 16, 2023

(65) Prior Publication Data

US 2024/0076102 A1 Mar. 7, 2024

Related U.S. Application Data

(60) Provisional application No. 63/241,276, filed on Sep. 7, 2021.

(51) Int. Cl.
*B65D 21/02* (2006.01)

(52) U.S. Cl.
CPC ..... *B65D 21/0228* (2013.01)

(58) Field of Classification Search
CPC ... B65D 21/0228; B65D 51/28; B67D 7/0294
USPC ..... 141/23–27, 38
See application file for complete search history.

(56) References Cited

U.S. PATENT DOCUMENTS 1,178,512 A * 4/1916 Garlock ..... A61J 1/2096 141/23
1,692,423 A * 11/1928 Shere ..... F16N 3/12 222/340
2,083,590 A * 6/1937 Barks ..... F16N 37/02 222/386

(Continued)

*Primary Examiner* — Timothy P. Kelly
(74) *Attorney, Agent, or Firm* — Mark C. Johnson; Johnson Dalal

(57) ABSTRACT

A container assembly to facilitate liquid transfer from a donor container to a recipient container that includes utilizing a first container and a second container, whereby the second container has a piston coupled to a sidewall thereon in a watertight configuration and that is operably configured to linearly translate within a second container cavity. The assembly includes a container linking structure selectively removably couplable to the second container in a watertight and male-female coupling configuration, a stem member selectively removably couplable to the piston in a male-female coupling configuration and having a grasping portion thereon, and a straw member attached to the linking structure, wherein the stem member is configured to apply a force on the piston to linearly translate the piston to generate a negative pressure within the enclosed conduit for transportation of liquid configured to be housed in the first container cavity to the second container.

11 Claims, 16 Drawing Sheets

(56) References Cited

U.S. PATENT DOCUMENTS

| | | | | |
|---|---|---|---|---|
| 2,266,827 | A * | 12/1941 | Sundholm | G01F 11/021 222/386 |
| 2,268,592 | A * | 1/1942 | Hothersall | F16N 37/02 222/386 |
| 2,620,114 | A * | 12/1952 | Graham | F16N 37/02 141/26 |
| 5,215,536 | A | 6/1993 | Lampropoulos et al. | |
| 6,726,389 | B1 * | 4/2004 | Lee | B05C 17/0325 141/205 |
| 2009/0178725 | A1 * | 7/2009 | Sonnier | G01F 11/027 141/346 |
| 2011/0175347 | A1 | 7/2011 | Okiyama | |
| 2014/0053947 | A1 | 2/2014 | Baldwin et al. | |

* cited by examiner

LINKING STRUCTURE AND CONTAINER ASSEMBLY TO FACILITATE LIQUID TRANSFER FROM A DONOR CONTAINER TO A RECIPIENT CONTAINER

FIELD OF THE INVENTION

The present invention relates generally to structures and methods to facilitate removal of liquid from one container to another container and, more particularly, relates to structures and methods involving the use of one or more structures couplable to a donor container and remove liquid from the donor container to a recipient container.

BACKGROUND OF THE INVENTION

Many users desire to effectively transfer liquid or other similar substances (for brevity, "liquid") from one container (e.g., donor container) to another container (e.g., recipient container) while minimizing contact from any user or contamination from any external outside source. Examples of such situations include enabling transportation of the liquid through security at an airport by transferring the liquid from a larger container to a smaller container, transferring liquid from a larger cosmetic container to a smaller cosmetic container for sampling by a user, etc.

Many known devices fail to provide an overall effective and efficient solution. For example, many known devices routinely allow liquid to escape from one or both of the container(s) and/or the structure linking the containers together. Further, many known structures and methods designed to facilitate in the transfer of liquid from one container to another container also permit the introduction of air or gas into the recipient container, which can degrade the liquid. Known structures and methods also typically employ an overall system that is cumbersome or difficult to use, thereby reducing the likelihood that users use the structure effectively, or even at all.

Therefore, a need exists to overcome the problems with the prior art as discussed above.

SUMMARY OF THE INVENTION

The invention provides a structure and method to facilitate liquid transfer from a donor container to a recipient container that overcomes the hereinafore-mentioned disadvantages of the heretofore-known devices and methods of this general type and that utilizes negative pressure to facilitate removal of liquid from a first container (termed a "donor" container) to a second container (termed a "recipient" container) without the use of an intermediate container and without contamination. The recipient container may be an "end-user" container that may be utilized for storing, transporting, or dispensing of the transferred liquid. The present invention minimizes loss of a liquid (e.g., cosmetic product) during transfer from the donor container containing the cosmetic product to the recipient container. The present invention also enables transfer of the liquid product into an airless container (i.e., second recipient container) with ease and with minimal loss of transferred product.

With the foregoing and other objects in view, there is provided, in accordance with the invention, a container assembly to facilitate liquid transfer from a donor container to a recipient container that includes a first container having a bottom wall, a sidewall surrounding the bottom wall, defining a first container cavity, and defining a first container upper enclosed opening fluidly coupled to the first container cavity. The assembly also includes a second container having a bottom wall, a sidewall surrounding the bottom wall of the second container, defining a second container cavity, defining a second container upper enclosed opening fluidly coupled to the second container cavity, having a piston coupled to the sidewall of the second container in a watertight configuration and operably configured to linearly translate within the second container cavity, and defining at least one air aperture through at least one of the sidewall of the second container and the bottom wall of the second container at a location outside of the piston translation path. The assembly also includes a container linking structure selectively removably couplable to the second container in a watertight and male-female coupling configuration, a stem member selectively removably couplable to the piston in a male-female coupling configuration and having a grasping portion thereon, and a straw member sized and shaped to be inserted within the first container upper enclosed opening and defining an enclosed conduit extending from a distal end of the straw member to the container linking structure, wherein the stem member is operably configured to apply a force on the piston to linearly translate the piston within the second container cavity and generate a negative pressure within the enclosed conduit for transportation of a liquid configured to be housed in the first container cavity to the second container.

In accordance with a further feature of the present invention, the container linking structure is selectively removably couplable to the second container in a hermetically sealed configuration.

In accordance with an exemplary feature of the present invention, the container linking structure is selectively removably couplable to the first container and the second container.

In accordance with an additional feature of the present invention, the bottom wall is selectively removably coupled to the sidewall of the second container in male-female coupling configuration.

In accordance with another feature, an embodiment of the present invention includes the second container having an internal flange radially extending in the second container cavity and configured to stop linear movement of the piston within the second container cavity.

In accordance with another feature, an embodiment of the present invention also includes the stem member having two cantilevered portions radially extending from a terminal end thereon and at least partially forming the grasping portion of the stem member.

In accordance with yet another feature, an embodiment of the present invention also includes the bottom wall further defining a stem aperture shaped and size to receive a diameter of the stem member therethrough.

In accordance with another feature, an embodiment of the present invention also includes the container linking structure having a clip member extending from an outer surface of the container linking structure and defining a U-shape.

In accordance with an additional feature, an embodiment of the present invention also includes a disk member surrounding the straw member and operably configured to have a biased position with the straw member disposed in an enclosed channel defined by the disk member and with straw member compressed to close the enclosed conduit and an un-biased position with the straw member disposed in the enclosed channel defined by the disk member and with straw member uncompressed to open the enclosed conduit.

In accordance with another feature, an embodiment of the present invention also includes an inner sidewall having a collapsible accordion configuration, with an upper portion selectively removably couplable to a secondary inner sidewall of the second container in a male-female coupling configuration, with a lower portion coupled to the piston, and defining an inner sidewall cavity, wherein the inner sidewall is operably configured to have a collapsed configuration along an inner sidewall translation path and an expanded configuration along the inner sidewall translation path within the second container cavity, wherein the stem member is operably configured to apply the force on the piston to linearly translate the piston and inner sidewall along the inner sidewall translation path within the second container cavity to generate the negative pressure within the enclosed conduit for transportation of the liquid configured to be housed in the first container cavity to the inner sidewall cavity.

In accordance with an additional feature, an embodiment of the present invention also includes the piston having at least one air intake aperture therethrough and fluidly uncoupled to the inner sidewall cavity.

In accordance with another feature, an embodiment of the present invention also includes a cap selectively removably couplable to the second container in a watertight and male-female coupling configuration to cover the second container upper enclosed opening.

Also in accordance with present invention, a container assembly to facilitate liquid transfer from a donor container to a recipient container is disclosed that includes a first container having a bottom wall, a flexible sidewall surrounding the bottom wall, defining a first container cavity, and defining a first container upper enclosed opening fluidly coupled to the first container cavity and a second container having a bottom wall defining at least one air aperture therethrough, a sidewall surrounding the bottom wall of the second container, defining a second container cavity, defining a second container upper enclosed opening fluidly coupled to the second container cavity, having a piston coupled to the sidewall of the second container in a watertight configuration and operably configured to linearly translate within the second container cavity. The assembly also includes a container linking structure selectively removably couplable to the first container and the second container in a watertight and male-female coupling configuration, having two opposing ends each defining an opening, defining a linking conduit separating the opposing ends of the container linking structure, having a lower one-way valve disposed within the linking conduit, and defining an intake aperture fluidly coupled to the linking conduit, interposed between one of the opposing ends of the container linking structure and the lower one-way valve, and having an upper one-way valve disposed within the intake aperture, wherein the flexible sidewall of the first container is operably configured to be depressed to induce a pressure therein and cause transportation of a liquid configured to be housed in the first container cavity to solely flow through the lower one-way valve and into the second container cavity and, when not depressed, cause transportation of external air through the upper one-way valve.

In accordance with another feature, an embodiment of the present invention also includes a stem member selectively removably couplable to the piston in a male-female coupling configuration, having a grasping portion thereon, and operably configured to apply a force on the piston to linearly translate the piston within the second container cavity and generate a negative pressure within the second container cavity for transportation of the liquid configured to be housed in the first container cavity through the lower one-way valve.

Although the invention is illustrated and described herein as embodied in a structure and method to facilitate liquid transfer from a donor container to a recipient container, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the containers, straw member, and/or, where applicable, a direction where a length of an object is greater than the diameter or width of that same object.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 3:
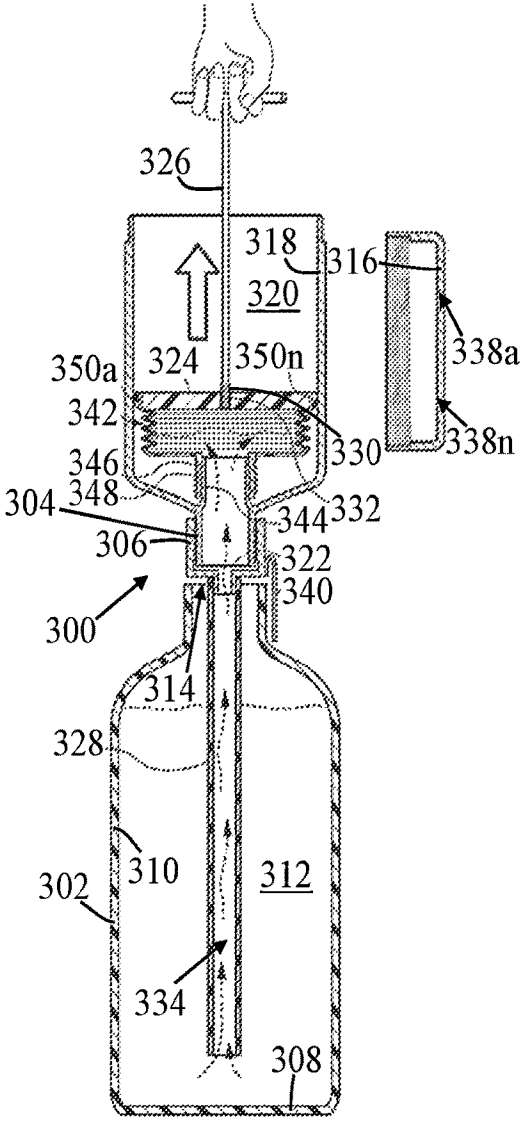
FIGS. 1-3 depict cross-sectional views of container assemblies to facilitate liquid transfer from a donor container to a recipient container in accordance with embodiments of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient system and method for facilitating the transfer of liquid from a first, donor, container to a second, recipient, container, wherein the recipient container is preferably of a size that is smaller than the size of the donor container. Specifically, referring to FIGS. 1-7, three embodiments of the present invention are shown. FIGS. 1-7 show several advantageous features of the present invention, but, as will be described below, the invention can be provided in several shapes, sizes, combinations of features and components, and varying numbers and functions of the components.

The container assemblies 100, 200, 300 are configured to effectively and efficiently facilitate in the liquid transfer from a donor container 102, 202, 302 to a recipient container 104, 204, 304. The first container 102, 202, 304 may include a bottom wall 108, 208, 308, a sidewall 110, 210, 310 surrounding the bottom wall 108, 208, 308, defining a first container cavity 112, 212, 312 and defines a first container upper enclosed opening 114, 214, 314 fluidly coupled to the first container cavity 112, 212, 312 whereby liquid is conventionally configured to flow therethrough. In one embodiment, the sidewall 110, 210, 310 is specifically configured to be of a flexible polymeric material, e.g., polyethylene terephthalate (PET) plastic. Flexibility of sidewall is particularly beneficial for embodiments of the assembly where the user causes (at least partially) the transfer of liquid from the donor container 802 to the recipient container 804 by depressing the sidewall of the donor container 802 (best depicted in FIGS. 8-9).

Figure 1:
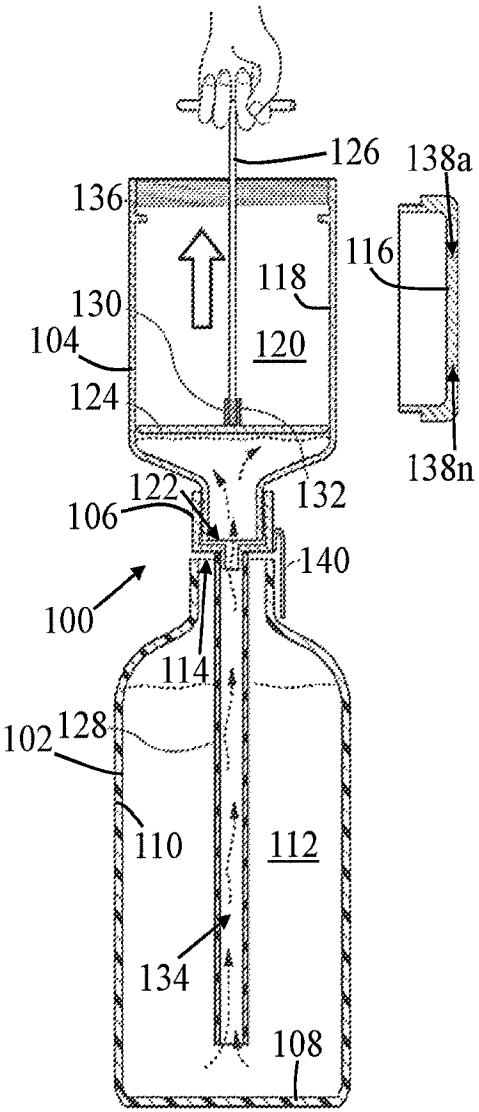
Figure 6:
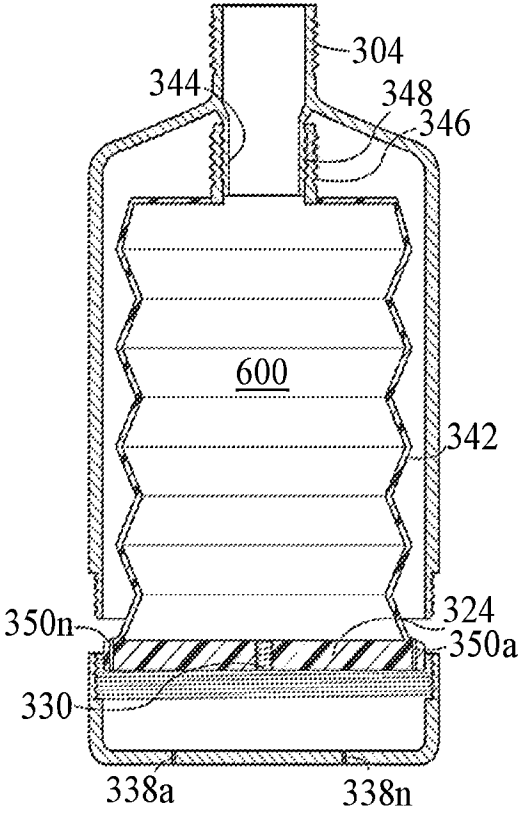
FIGS. 4-6 depict fragmentary views of a second (recipient) container utilized in the container assemblies in FIGS. 1-3 in accordance with embodiments of the present invention.

It should be understood that terms such as, "front," "rear," "side," top," "bottom," and the like are indicated from the reference point of a viewer viewing the assembly has shown in FIG. 1 and as the bottles are typically supported and held in an upright orientation, wherein other reference points are possible. As used herein, the term "wall" is intended broadly to encompass continuous structures, as well as, separate structures that are coupled together so as to form a substantially continuous external surface (possibly with apertures formed thereon, where indicated or depicted).

Still reference to FIGS. 1-7, the assemblies 100, 200, 300 also include a second container 104, 204, 304 having a bottom wall 116, 216, 316 defining at least one air aperture 138*a-n*, 238*a-n*, 338*a-n* therethrough (wherein "n" represents any number greater than one). While the air aperture(s) may be defined by the bottom wall 116, 216, 316, the air aperture(s) 138*a-n*, 238*a-n*, 338*a-n* may also be additional defined by or solely defined by the sidewall of the second container 104, 204, 304. Said another way and using FIG. 1 by way of example, the piston 124 is operably configured to linearly translate along a piston translation path (where it begins, e.g., at the flange 136, and terminates, e.g., at an internal shoulder within the second container 104) within the second container cavity and the second container 104 defines one or more air aperture(s) 138*a-n* through one or both of the bottom wall 116 and/or the sidewall 118 and at a location outside of the piston translation path. The one or more aperture(s) 138*a-n*, 238*a-n*, 338*a-n* are beneficially formed to create a low-pressure environment, such as during air travel, by virtue of separating product from air and having airholes to allow for airflow to accommodate changes in outside air pressure and to also equalize pressure in the second cavity 120, 220, 320 defined by the secondary container 104, 204, 304. Specifically, the second container 104, 204, 304 also includes a sidewall 118, 218, 318 surrounding the bottom wall 116, 216, 316 of the second container 104, 204, 304. The sidewall 118, 218, 318 may also define an inner diameter separating opposing inner surfaces of the sidewall 118, 218, 318.

The second container 104, 204, 304 also defines a second container cavity 120, 220, 320 and defines a second container upper enclosed opening 122, 222, 322 fluidly coupled to the second container cavity 120, 220, 320, whereby liquid is configured to be poured out the second container upper enclosed opening 122, 222, 322 when there is nothing attached thereto. The second container 104, 204, 304 also includes a piston 124, 224, 324 coupled to the sidewall 118 of the second container 104 in a watertight configuration so that liquid (e.g., cosmetic) is unable to be passed through the piston 124, 224, 324. Said another way, the piston 124, 224, 324 may span the inner diameter of the sidewall 118, 218, 318. The piston 124, 224, 324 is preferably of a substantially rigid material capable of withstanding the pressures generated within the second container 104, 204, 304 without deformation that cause leakage of the liquid therethrough. Additionally, the piston 124, 224, 324 may be seated on a gasket of a deformable material (e.g., natural rubber) and with a low coefficient of friction to enable effective translation of the piston 124, 224, 324. The piston 124, 224, 324 is operably configured to linearly translate within the second container cavity 120 and preferably includes a substantially planar upper surface (as shown) to maximize the volume in the second container cavity 120, 220, 320.

The assemblies 100, 200, 300 also include a container linking structure 106, 206, 306 selectively removably couplable to the second container 104 in a watertight and male-female coupling configuration. The "male-female" coupling configuration may include two corresponding tongue-and-groove configurations that can mate or be joined together, e.g., a threaded configuration, a flat or notched tongue and a flat or recessed groove, etc. In one embodiment, the container linking structure 106, 206, 306 is selectively removably couplable to the second container 104, 204, 304 in a hermetically sealed configuration. In some embodiments, the container linking structure 106, 206, 306 is selectively removably couplable to the first container 102, 202, 302 and the second container 104, 204, 304 with a male-female coupling configuration.

The assemblies 100, 200, 300 may also beneficially include a stem member 126, 226, 326 selectively removably couplable to the piston 124, 224, 324 in a male-female coupling configuration. The stem member 126, 226, 326 is preferably also of a substantially rigid material, like the piston. Specifically, in one embodiment, the piston 124, 224, 324 may include a female threaded wall 130, 230, 330 defined on (e.g., recessed on) the piston 124, 224, 324 and the stem member 126, 226, 326 may include a male threaded wall 132, 232, 332 defined on a terminal end thereof. The stem member 126, 226, 326 also beneficially includes a grasping portion thereon, i.e., a portion that is shaped and sized to be grasped by a single hand of a user. In one embodiment, the stem member 126, 226, 326 includes two cantilevered portions radially extending from a terminal end thereon (opposite the end having the male threaded wall) and at least partially forms the grasping portion of the stem member 126. This configuration beneficially enables the user to apply a force on the stem member 126, 226, 326 to move it up and down in the second container cavity 120, 220, 320.

In one embodiment (as exemplified in FIG. 1 and FIG. 4), the bottom wall 116 is selectively removably coupled to the sidewall 118 of the second container 104 in male-female coupling configuration, thereby enabling a user to obtain access to the second container cavity 120 and piston 124 disposed therein. The second container 104 may also include an internal flange 136 radially extending in the second container cavity 120 and configured to stop linear movement of the piston 124 within the second container cavity 120. In one embodiment, the flange 136 continually extends around an inner surface of the sidewall 118 and preferably at least extends from two opposing inner surfaces of the sidewall 118.

Figure 2:
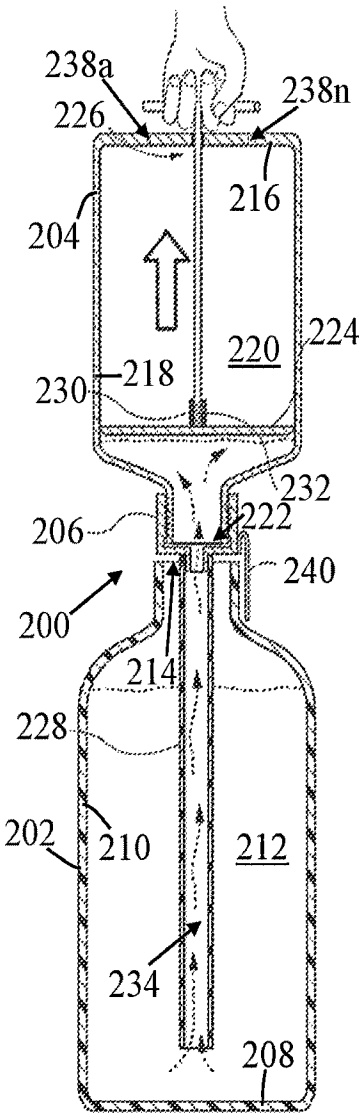
Figure 5:
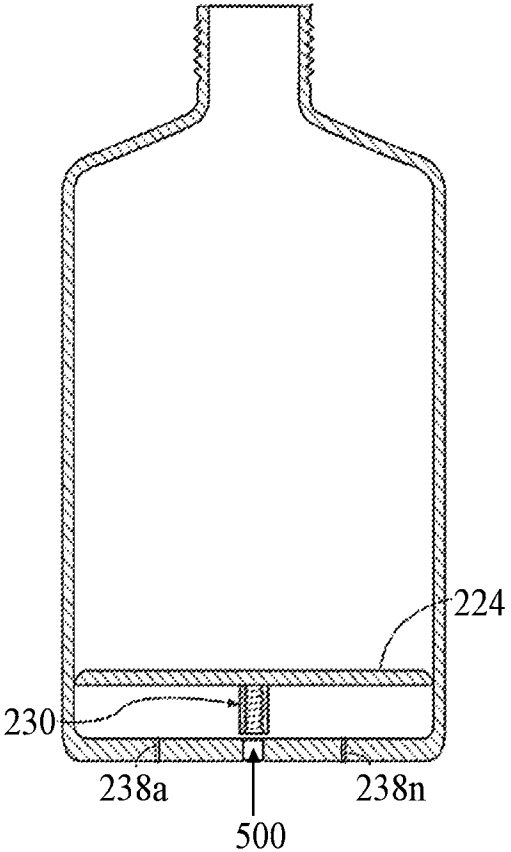
Figure 4:
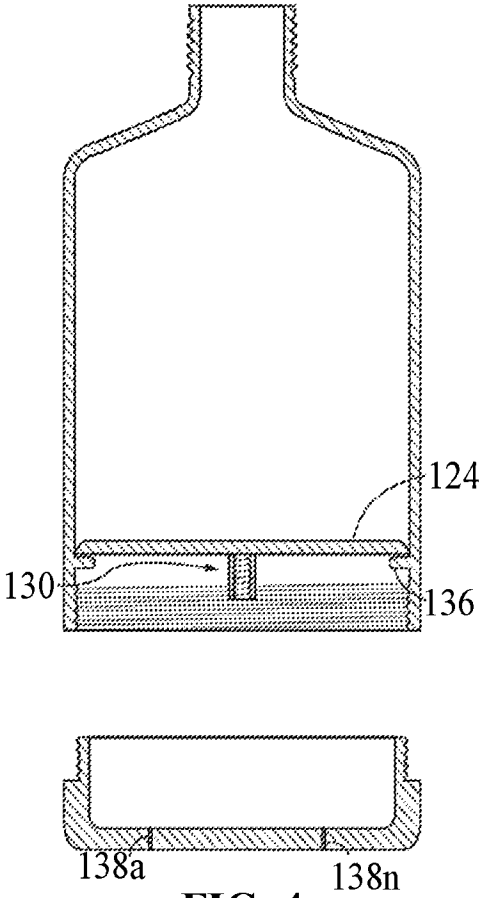
Figure 7:
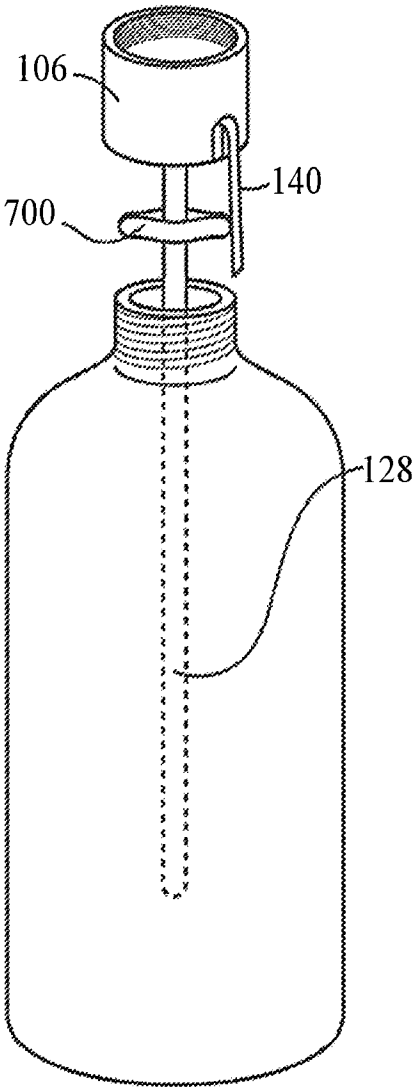
FIG. 7 is a perspective view of a first (donor) container couplable to a container linking structure and straw member in accordance with one embodiment of the present invention.

As best seen exemplified in FIG. 2 and FIG. 5, the bottom wall 116 further defines a stem aperture 500 shaped and size to receive a diameter of the stem member 126 therethrough. In one embodiment, the stem aperture 500 is slightly larger (e.g., about 2% or less) than a uniform diameter of the stem member 126 to enable the stem member 126 to be inserted and removed therefrom without removing the bottom wall.

The assemblies 100, 200, 300 can also be seen having a straw member 128, 228, 328 that is preferably flexible and sized and shaped to be inserted within the first container upper enclosed opening 114, 214, 314. In some embodiments, the length of the straw member 128, 228, 328 is sufficient to reach the bottom wall of the first container 102, 202, 304. The straw member 128, 228, 328 defines an enclosed conduit 134, 234, 334 extending from a distal end of the straw member 128, 228, 328 to the container linking structure 106, 206, 306. As indicated by the arrows in FIGS. 1-3, the stem member 126, 226, 326 is operably configured to apply a force on the piston 124, 224, 324 to linearly translate the piston 124, 224, 324 within the second container cavity 120, 220, 320 and generate a negative pressure within the enclosed conduit 134, 234, 334 for transportation of a liquid configured to be housed in the first container cavity 112, 212, 312 to the second container 104, 204, 304, namely the portion of the second container cavity disposed above the upper surface of the piston 124, 224, 324.

In one embodiment (exemplified using FIG. 1 and FIG. 4), the assembly 100 includes a clip member 140 extending from an outer surface of the container linking structure 106, wherein the clip member 140 defines a U-shape. The clip member 140 enables the users to clip or hang the clip member 140 onto the sidewall 110 of the first container 102 (preferably the portion defining the mouth of the container) after the desired amount of liquid has been removed from the first container 102. Further, a disk member 700 may be utilized to facilitate in removing any liquid retained within the enclosed conduit 134. The disk member 700 can be seen surrounding the straw member 128 and is operably configured to have a biased position (e.g., when depressed by the user) with the straw member 128 disposed in an enclosed channel defined by the disk member 700 and with straw member 128 compressed to close the enclosed conduit 134.

The disk member 700 has an un-biased position with the straw member 128 disposed in the enclosed channel defined by the disk member 700 and with straw member 128 uncompressed to open the enclosed conduit 134. When placed in the biased position, the user will slide the disk member 700 down the straw member 128, thereby allowing a user to remove any liquid in the straw member 128 after use and place back it in the first container 102.

In one embodiment (as exemplified in FIG. 3 and FIG. 6), the assembly 300 includes an inner sidewall 342 having a collapsible accordion configuration, with an upper portion selectively removably couplable to a secondary inner sidewall 344 of the second container 104 in a male-female coupling configuration (indicated with arrows 346, 348), and with a lower portion coupled to the piston 324. In one embodiment, the secondary inner sidewall 344 is concentrically disposed relative to the sidewall 318 and extends less than 10-15% of the overall length of the second container 104 into the second container cavity 320. The inner sidewall 342 can be seen defining an inner sidewall cavity 600, wherein the inner sidewall 342 is operably configured to have a collapsed configuration along an inner sidewall translation path and an expanded configuration along the inner sidewall translation path within the second container cavity 320. The stem member 326 is operably configured to apply the force on the piston 324 to linearly translate the piston 324 and inner sidewall 342 along the inner sidewall translation path within the second container cavity 320 to generate the negative pressure within the enclosed conduit 334 for transportation of the liquid configured to be housed in the first container cavity 312 to the inner sidewall cavity 600. To that end, the piston 324 includes one or more air intake aperture(s) therethrough that are fluidly uncoupled to the inner sidewall cavity 600.

As such, when desired for use, the user will remove any applicable cap or cover from the first container 102 to expose the first container upper enclosed opening 114. The user will then attach (if it is not done already, temporarily or permanently) the straw member 128 to the container linking structure 106, which is then coupled to the second container 104, with the straw member 128 disposed therein. The user will then insert the stem member 126 into the second container cavity 120 to attach the stem member 126 to the piston 124. After attachment, the user will then pull back on the stem member 126 and piston 124 to induce the negative pressure, thereby evacuating the liquid housed in the first container 102 to the second container in the desired amount and in an effective and efficient manner. The stem member 126 may then be removed from the piston 124 and the container linking structure 106 may disconnected from the container(s) and set on the first container 102, whereby any liquid still in the straw member 128 can be evacuated as discussed above. Thereafter, the user may place a cap, that may be selectively removably couplable to the second container 104, on the second container 104 in a watertight and male-female coupling configuration to cover the second container upper enclosed opening 122 and for ease of transportation and use.

Figure 8:
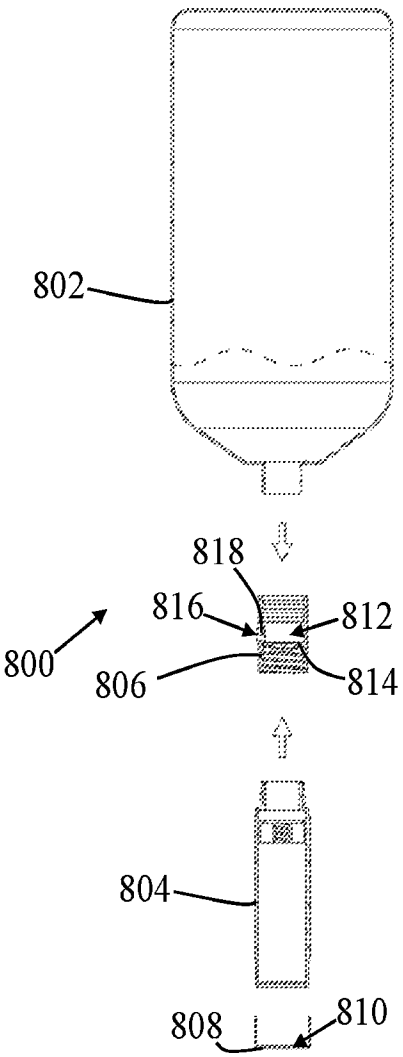
FIG. 8 depicts an exploded view of a container assembly to facilitate liquid transfer from a donor container to a recipient container in accordance with an embodiment of the present invention.
Figure 9:
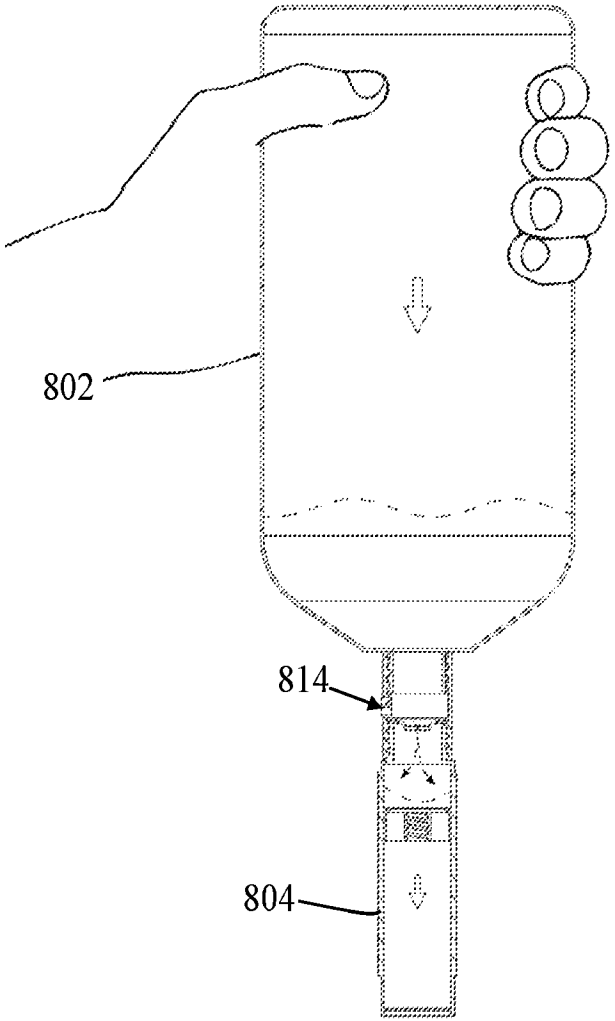
FIG. 9 depicts a perspective view of the container assembly in FIG. 8 assembled in accordance with an embodiment of the present invention.

With reference to FIGS. 8-9, another embodiment of the present invention is depicted. Specifically, a container assembly 800 is utilized to facilitate liquid transfer from a donor container to a recipient container that also includes a first container 802 as depicted and described above. The second container 804, like depicted and describe above, has a bottom wall 808 defining one or more air aperture(s) 810 therethrough, has a sidewall surrounding the bottom wall of the second container, defines a second container cavity, defines a second container upper enclosed opening fluidly coupled to the second container cavity, has a piston coupled to the sidewall of the second container in a watertight configuration and is operably configured to linearly translate within the second container cavity.

Beneficially, the container linking structure 806 is selectively removably couplable to the first container 802 and the second container 804 in a watertight and male-female coupling configuration and has two opposing ends each defining an opening. The container linking structure 806 defines a linking conduit 812 separating the opposing ends of the container linking structure 806 and has a lower one-way valve 814 disposed within the linking conduit 812. The container linking structure 806 also defines an intake aperture 816 fluidly coupled to the linking conduit 812, interposed between one of the opposing ends of the container linking structure 806 and the lower one-way valve 814, and has an upper one-way valve 818 disposed within the intake aperture 816.

The lower one-way valve 814 may only permit directional flow of a fluid from the first container 802 to the second container 804 and the upper one-way valve 818 may only permit directional flow of a fluid from an external ambient environment to inside the linking conduit 812. As such, the flexible sidewall of the first container 802 is operably configured to be depressed to induce a pressure therein and cause transportation of a liquid configured to be housed in the first container cavity to solely flow through the lower one-way valve 814 and into the second container cavity and, when not depressed, cause transportation of external air through the upper one-way valve 818 and into the cavity of the first container 802. To further evacuate a liquid (particularly some viscous liquids) in the first container 802, a stem member may also be selectively removably couplable to the piston in a male-female coupling configuration, wherein the stem member includes a grasping portion thereon and is operably configured to apply a force on the piston to linearly translate the piston within the second container cavity and generate a negative pressure within the second container cavity for transportation of the liquid configured to be housed in the first container cavity through the lower one-way valve 814.

Figure 11:
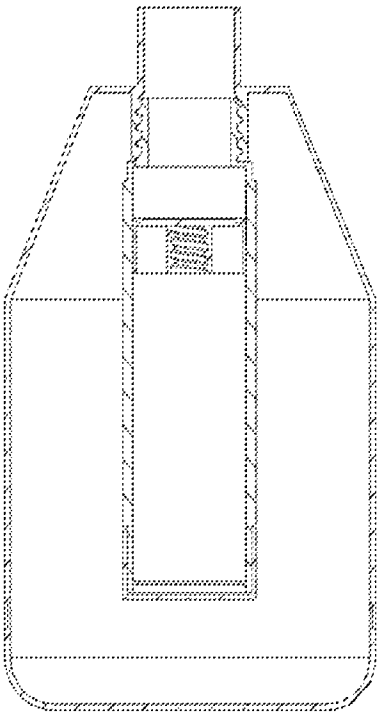
FIGS. 10-11 depict cross-sectional views of a second (recipient) container utilized with a container assembly to facilitate liquid transfer from a donor container to a recipient container in accordance with an embodiment of the present invention.
Figure 10:
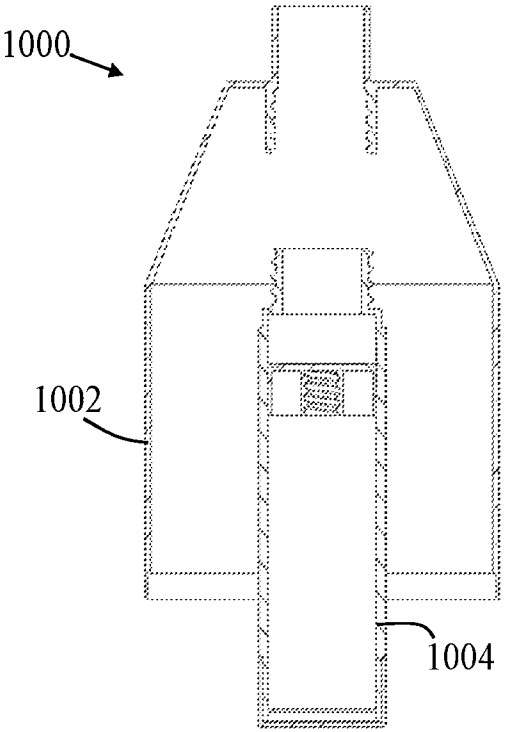

With reference to FIGS. 10-11, another embodiment of a portion of a container assembly 1000 to facilitate liquid transfer from a donor container to a recipient container, wherein the recipient container 1002 is depicted having two portions. Said another way, a bottle within a bottle embodiment is depicted wherein, like the accordion embodiment depicted in FIG. 3, second container 1002 includes an inner sidewall of a secondary container 1004 that is selectively removably couplable to the second container 1002 and utilized to draw liquid (product) from the first container, thereby providing a more attractive external presentation (e.g., a white internal bottle with a clear plastic external container).

Figure 12:
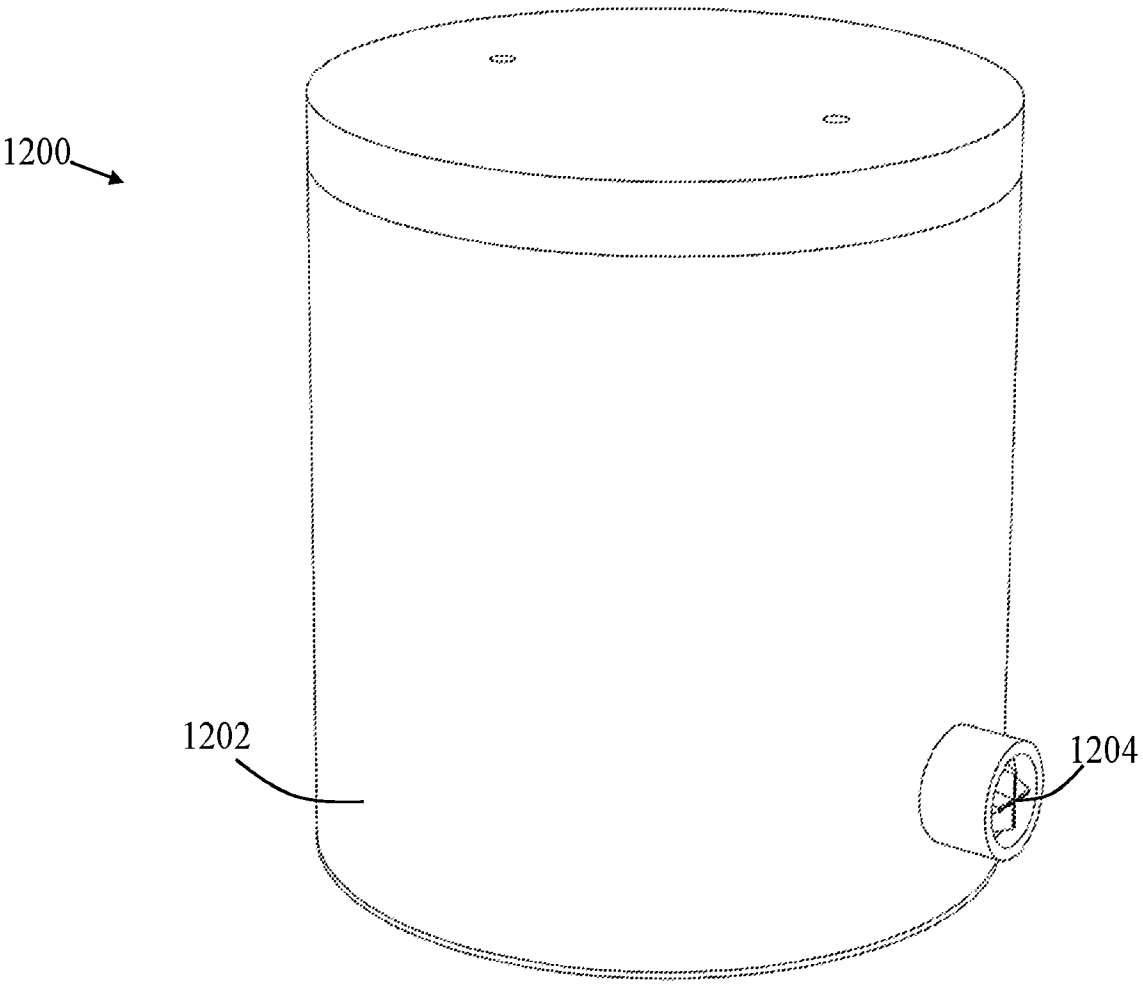
FIG. 12 depicts a perspective view of a first (donor) container utilized with a container assembly to facilitate liquid transfer from a donor container to a recipient container in accordance with an embodiment of the present invention.
Figure 14:
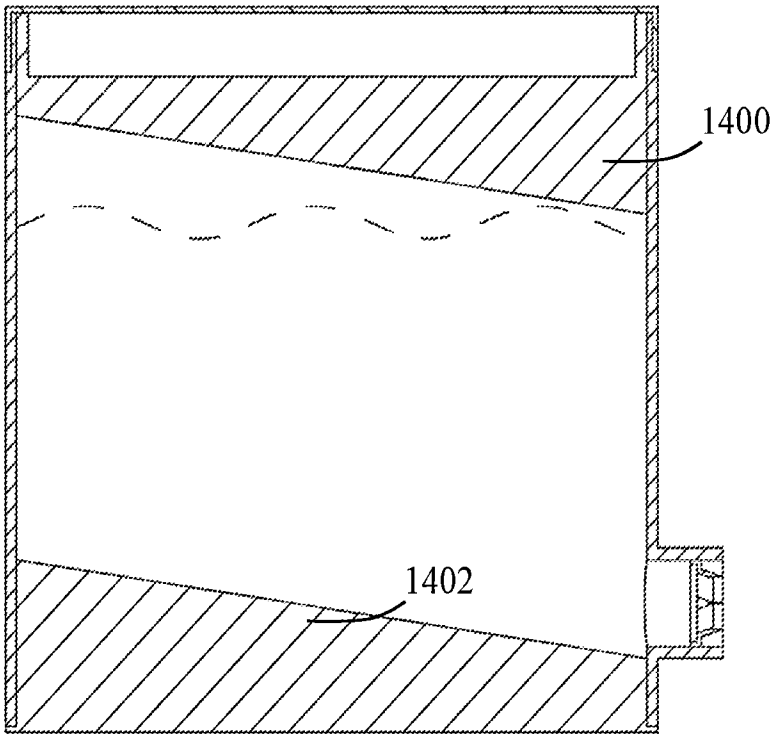
FIG. 14 depicts a cross-sectional view of the first (donor) container in FIG. 12.
Figure 13:
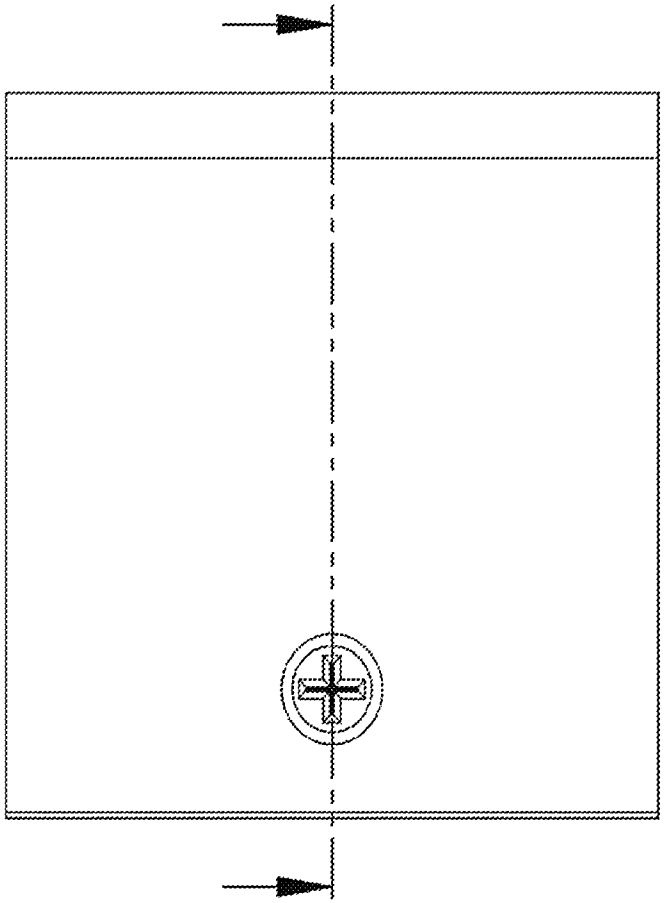
FIG. 13 depicts an elevational view of the first (donor) container in FIG. 12.
Figure 15:
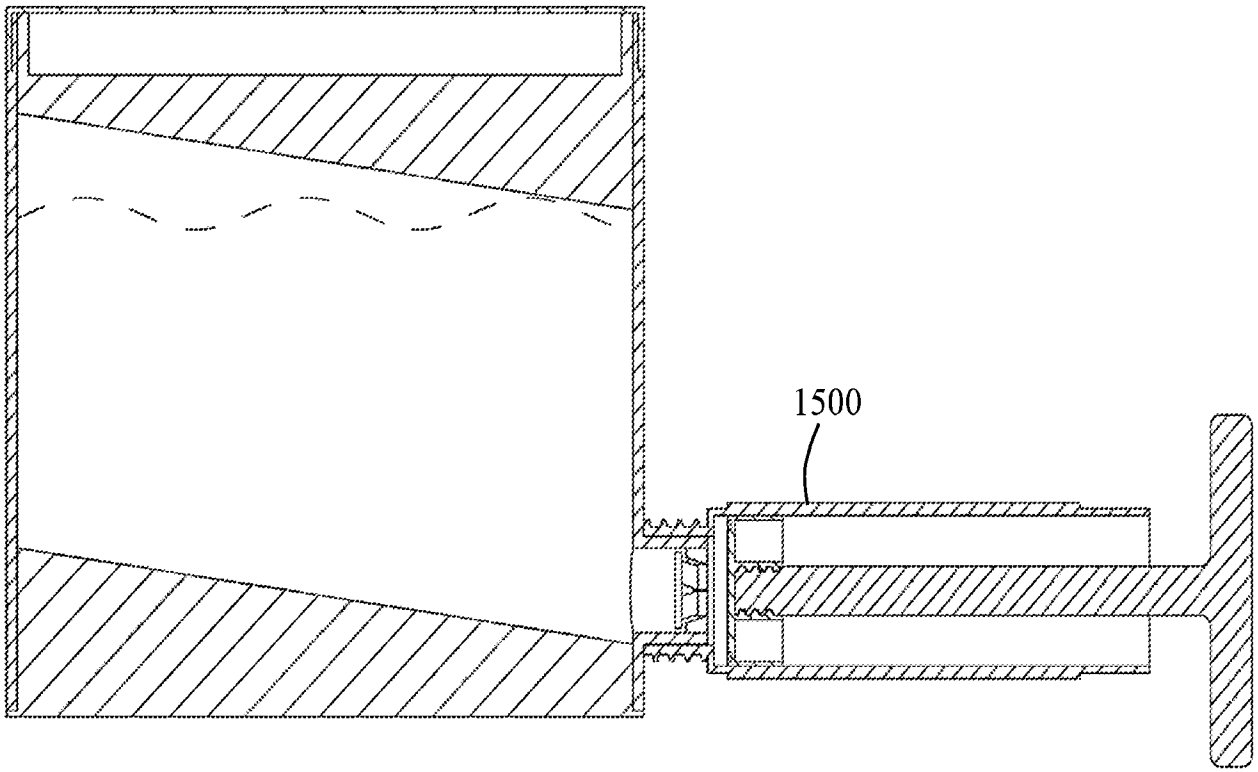
FIGS. 15-16 depict cross-sectional views of the first (donor) container in FIG. 12 coupled to a second (recipient) container in accordance with an embodiment of the present invention.
Figure 16:
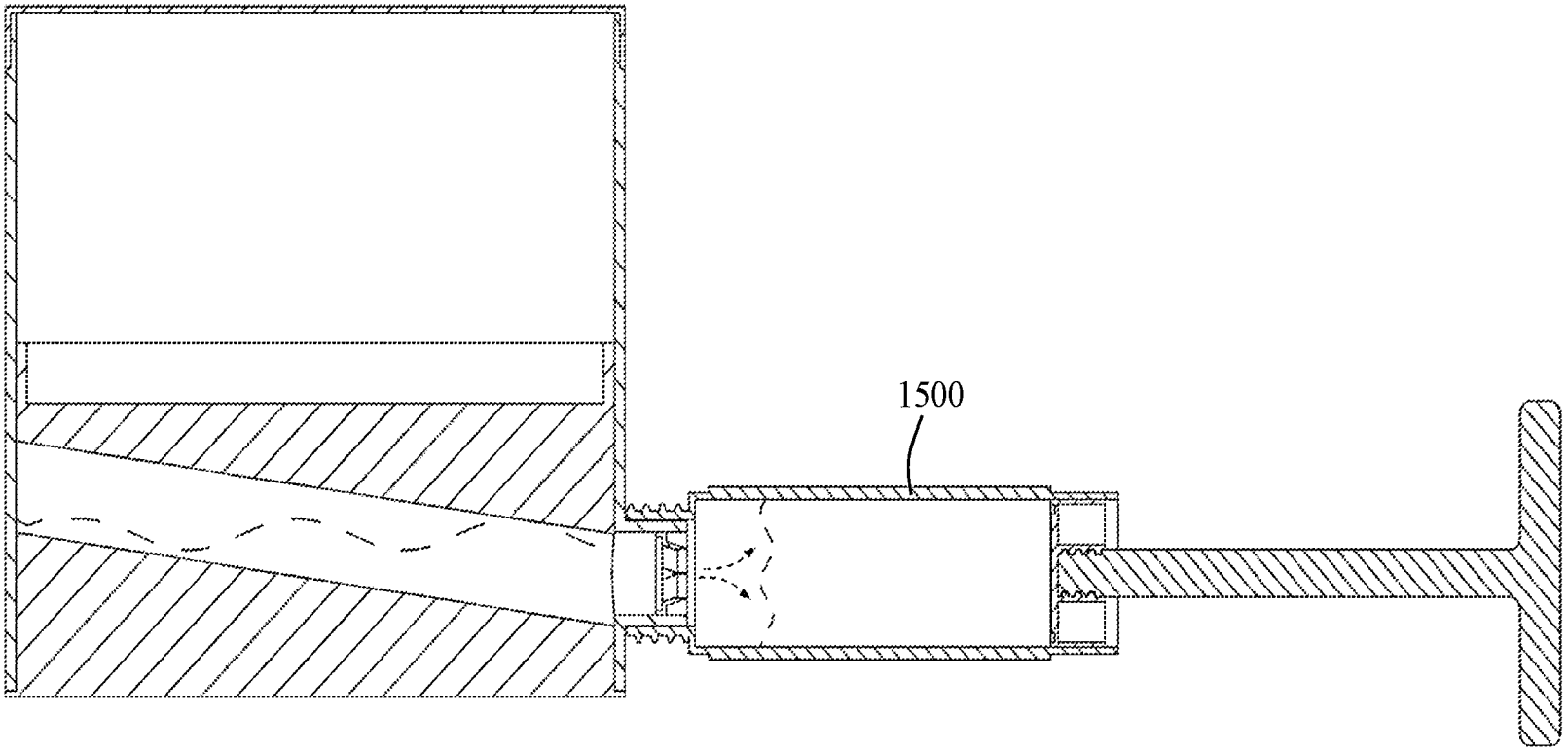
Figure 17:
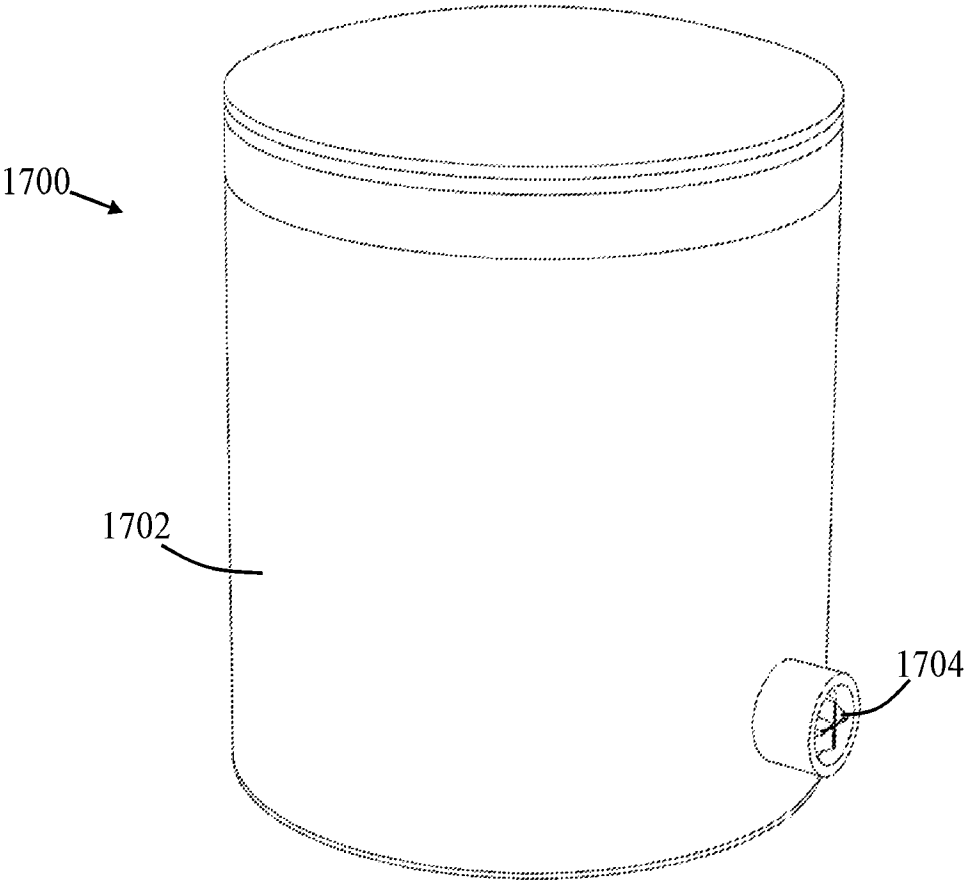
FIG. 17 depicts a perspective view of a first (donor) container utilized with a container assembly to facilitate liquid transfer from a donor container to a recipient container in accordance with an embodiment of the present invention.
Figure 19:
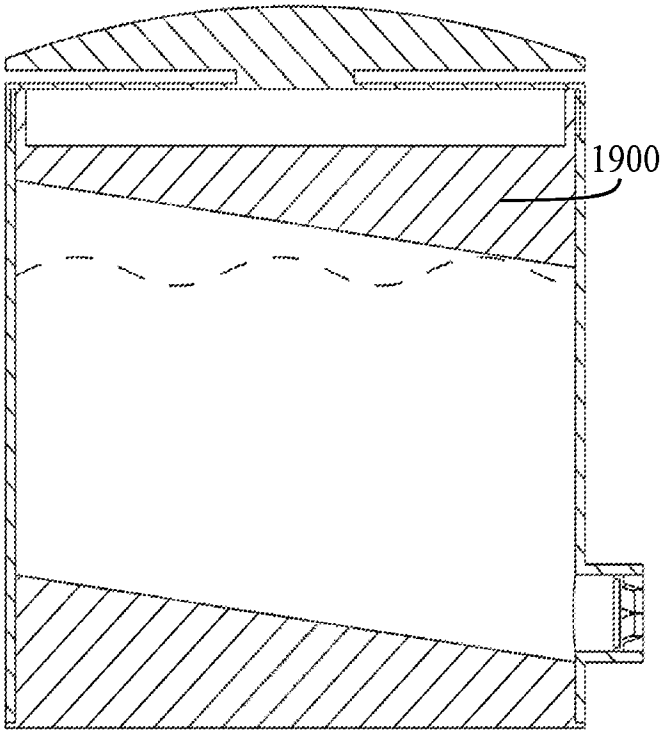
FIG. 19 depicts a cross-sectional view of the first (donor) container in FIG. 17.
Figure 18:
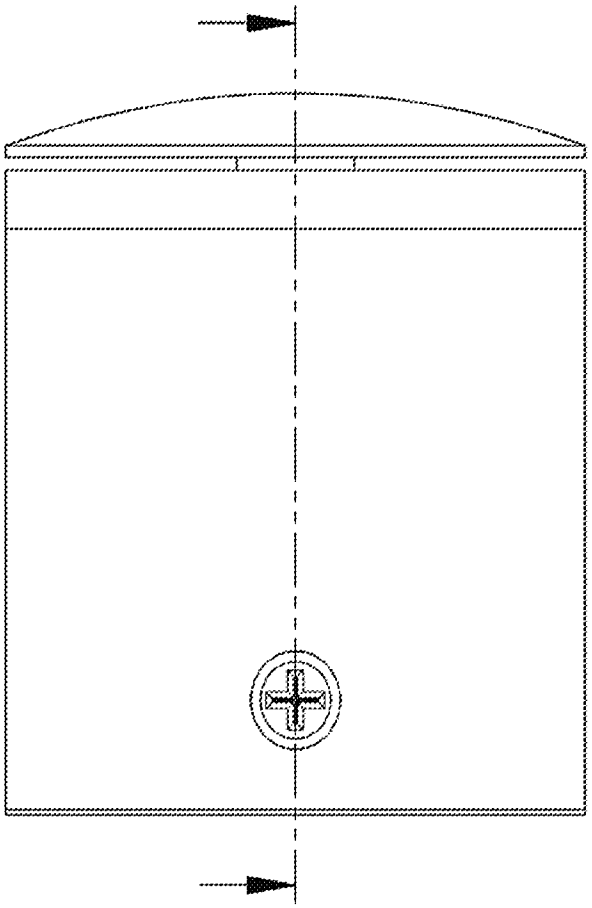
FIG. 18 depicts an elevational view of the first (donor) container in FIG. 17.
Figure 20:
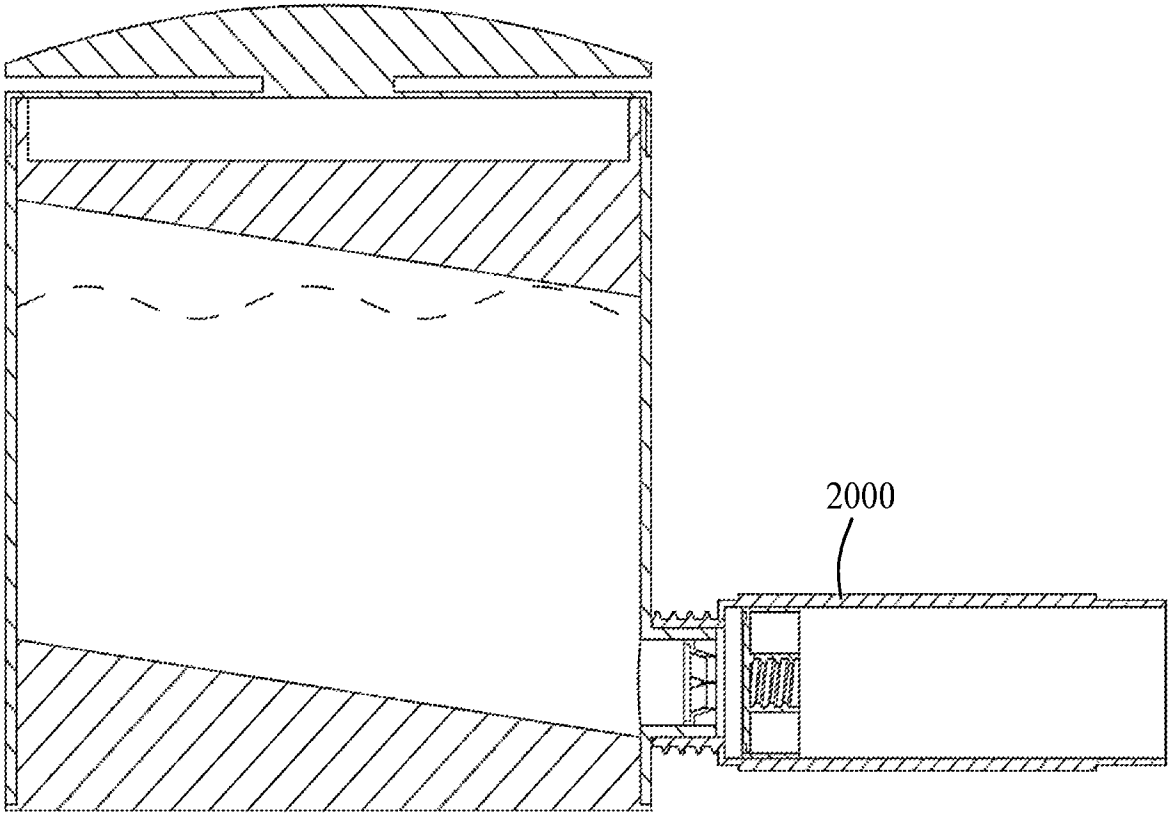
FIGS. 20-21 depict cross-sectional views of the first (donor) container in FIG. 17 coupled to a second (recipient) container in accordance with an embodiment of the present invention.
Figure 21:
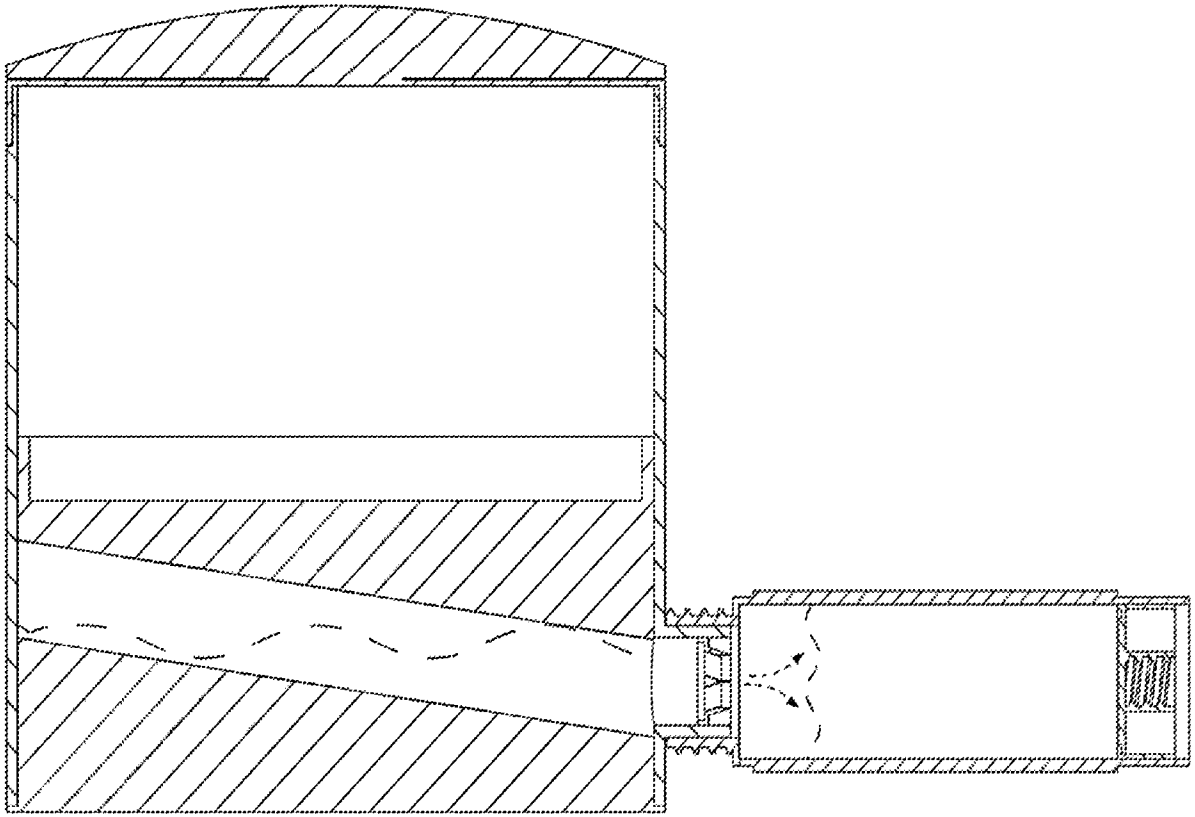
Figure 23:
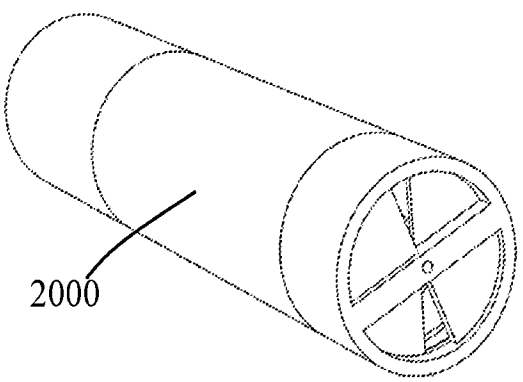
FIGS. 22-24 depict perspective views of a second (recipient) container with the rear end in various configurations providing adjustability of airflow to a cavity defined by the second container.
Figure 22:
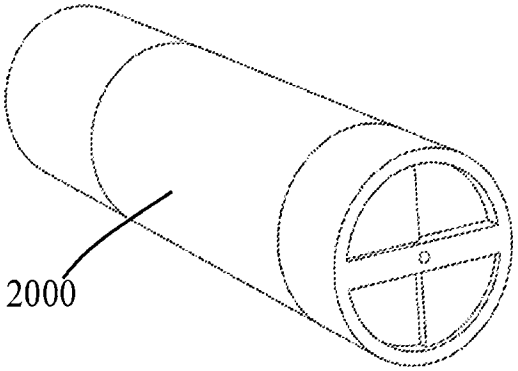
Figure 24:
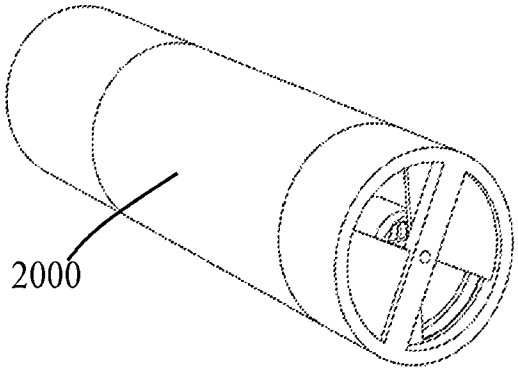

With reference to FIGS. 12-24, alternative embodiments of the assembly are depicted. Specifically, both assemblies 1200, 1700 include a first container 1202, 1702 with a piston 1400, 1900 operably configured to linearly translate therein and force liquid housed therein to exit an enclosed aperture, wherein aperture preferably has a one-way valve 1204, 1704 disposed therein. While the embodiment of the assembly 1200 in FIG. 12 requires a second container 1500 with a piston incorporated therein that is actuated with a stem member, the embodiment of the assembly 1700 depicted in FIG. 17 includes a pump operably configured to generate a pressure to drive the piston 1900 up or down. As shown in FIGS. 19-21, the pump causes the piston 1900 to force liquid in the first container 1702 through the one-way valve 1704 and into the second container 2000. The second container 2000 may also utilize a stem member to further effectuate removal of liquid from the first container 1702. Beneficially, the lower surfaces defined by the bottom walls in the assemblies 1200, 1700 are sloped or angled toward the enclosed apertures, thereby creating a structure conducive to removing all liquid from the first container 1202, 1702. FIGS. 22-24 depict the second container 2000 with the rear end in various configurations providing adjustability to the airflow to the cavity defined by the second container, wherein the center aperture will always provide airflow to the second container cavity.

Figure 25:
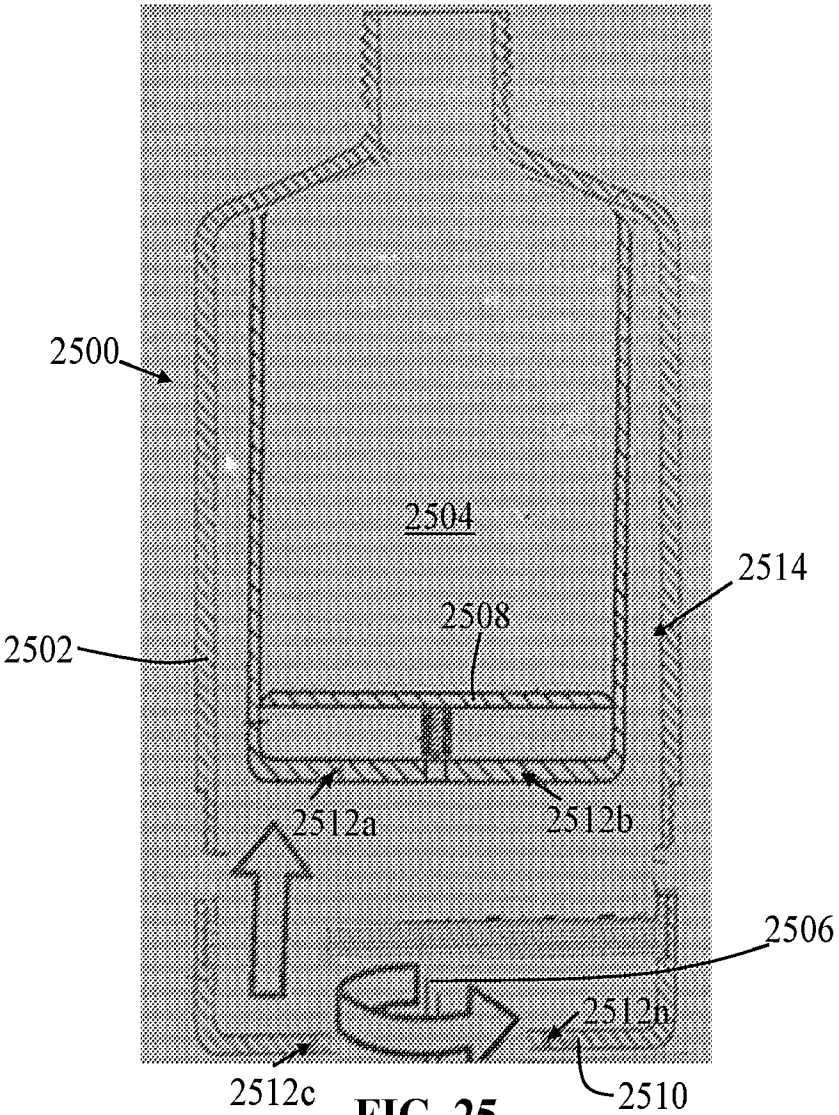
FIG. 25 depicts a cross-sectional view of a second (recipient) container with an inner wall configuration in accordance with one embodiment of the present invention.

With reference to FIG. 25, a cross-sectional view of a second (recipient) container 2500 is depicted with an inner wall configuration 2502 in accordance with one embodiment of the present invention. The inner wall 2502 is placed inside the second container cavity 2514 and defines its own cavity 2504 for receiving a liquid from the first (donor) container utilize, for example a stem member 2506 (partially shown) that may be rotationally coupled (represented with an arrow) to a piston 2508 disposed within the cavity 2504. The inner wall 2502 may be permanently coupled to the sidewall of the second container 2500 using, for example, sonic welding or adhesive. Similar to the embodiment depicted in FIGS. 10-11, the bottom wall 2510 may be selectively removably coupled (represented with an arrow) to the second container 2500 to allow access to the piston 2508 and may include a plurality of air intake aperture(s) 2512*a-n*. This double-wall configuration enables user to place a customizable or printed label on the outside surface of the second container 2500, while placing the liquid inside the cavity 2504 and minimizing exposure to water.

Although a specific order of executing utilization steps has been disclosed and depicted in the drawings, the order of executing the steps may be changed relative to the order shown in certain embodiments. Also, two or more steps shown or described as occurring in succession may be executed concurrently or with partial concurrence in some embodiments. Certain steps may also be omitted for the sake of brevity. In some embodiments, some or all of the process steps can be combined into a single process.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above-described features.

What is claimed is:

1. A container assembly to facilitate liquid transfer from a donor container to a recipient container comprising:

a first container having a bottom wall, a sidewall surrounding the bottom wall, defining a first container cavity, and defining a first container upper enclosed opening fluidly coupled to the first container cavity;

a second container having a bottom wall, having a sidewall surrounding the bottom wall of the second container and with the bottom wall of the second container selectively removably coupled thereto in a male-female coupling configuration, defining a second container cavity, defining a second container upper enclosed opening fluidly coupled to the second container cavity, having a piston coupled to the sidewall of the second container in a watertight configuration and operably configured to linearly translate along a piston translation path within the second container cavity, having an internal flange disposed between the piston and the removable bottom wall of the second container, radially extending in the second container cavity, and configured to stop linear movement of the piston along the piston translation path, and defining at least one air aperture through at least one of the sidewall of the second container and the bottom wall of the second container at a location outside of the piston translation path, the bottom wall having a lower planar surface separating two opposing sides of the sidewall of the second container;

a container linking structure selectively removably couplable to the second container in a watertight and male-female coupling configuration;

a stem member selectively removably couplable to the piston in a male-female coupling configuration and having a grasping portion thereon; and a straw member sized and shaped to be inserted within the first container upper enclosed opening and defining an enclosed conduit extending from a distal end of the straw member to the container linking structure, the stem member operably configured to apply a force on the piston to linearly translate the piston within the second container cavity and generate a negative pressure within the enclosed conduit for transportation of a liquid configured to be housed in the first container cavity to the second container.

2. The container assembly according to claim 1, wherein:

the container linking structure is selectively removably couplable to the second container in a hermetically sealed configuration.

3. The container assembly according to claim 1, wherein:

the container linking structure is selectively removably couplable to the first container and the second container.

4. The container assembly according to claim 1, wherein the stem member further comprises:

two cantilevered portions radially extending from a terminal end thereon and at least partially forming the grasping portion of the stem member.

5. The container assembly according to claim 1, wherein the bottom wall of the second container further defines a stem aperture shaped and size to receive a diameter of the stem member therethrough.

6. The container assembly according to claim 1, wherein the container linking structure further comprises:

a clip member extending from an outer surface of the container linking structure and defining a U-shape.

7. The container assembly according to claim 1, further comprising:

a disk member surrounding the straw member and operably configured to have a biased position with the straw member disposed in an enclosed channel defined by the disk member and with straw member compressed to close the enclosed conduit and an un-biased position with the straw member disposed in the enclosed channel defined by the disk member and with straw member uncompressed to open the enclosed conduit.

8. The container assembly according to claim 1, further comprising:

an inner sidewall having a collapsible accordion configuration, with an upper portion selectively removably couplable to a secondary inner sidewall of the second container in a male-female coupling configuration, with a lower portion coupled to the piston, and defining an inner sidewall cavity, the inner sidewall operably configured to have a collapsed configuration along an inner sidewall translation path and an expanded configuration along the inner sidewall translation path within the second container cavity, wherein the stem member is operably configured to apply the force on the piston to linearly translate the piston and inner sidewall along the inner sidewall translation path within the second container cavity to generate the negative pressure within the enclosed conduit for transportation of the liquid configured to be housed in the first container cavity to the inner sidewall cavity.

9. The container assembly according to claim 8, wherein the piston further comprises:

at least one air intake aperture therethrough and fluidly uncoupled to the inner sidewall cavity.

10. The container assembly according to claim 1, further comprising:

a cap selectively removably couplable to the second container in a watertight and male-female coupling configuration to cover the second container upper enclosed opening.

11. A container assembly to facilitate liquid transfer from a donor container to a recipient container comprising:

a first container having a bottom wall, a sidewall surrounding the bottom wall, defining a first container cavity, and defining a first container upper enclosed opening fluidly coupled to the first container cavity;

a second container having a bottom wall, a sidewall surrounding the bottom wall of the second container, defining a second container cavity, defining a second container upper enclosed opening fluidly coupled to the second container cavity, having a piston coupled to the sidewall of the second container in a watertight configuration and operably configured to linearly translate along a piston translation path within the second container cavity, and defining at least one air aperture through at least one of the sidewall of the second container and the bottom wall of the second container at a location outside of the piston translation path;

an inner sidewall having a collapsible accordion configuration, with an upper portion selectively removably couplable to a secondary inner sidewall of the second container in a male-female coupling configuration, with a lower portion coupled to the piston, and defining an inner sidewall cavity, the inner sidewall operably configured to have a collapsed configuration along an inner sidewall translation path and an expanded configuration along the inner sidewall translation path within the second container cavity;

a container linking structure selectively removably couplable to the second container in a watertight and male-female coupling configuration;

a stem member selectively removably couplable to the piston in a male-female coupling configuration and having a grasping portion thereon; and a straw member sized and shaped to be inserted within the first container upper enclosed opening and defining an enclosed conduit extending from a distal end of the straw member to the container linking structure, the stem member operably configured to apply a force on the piston to linearly translate the piston and inner sidewall along the inner sidewall translation path within the second container cavity and generate a negative pressure within the enclosed conduit for transportation of a liquid configured to be housed in the first container cavity to the second container.

* * * * *